US005355945A

United States Patent [19]

Sanz et al.

[11] Patent Number: 5,355,945

[45] Date of Patent: Oct. 18, 1994

[54] HEAT EXCHANGER AND METHOD OF FABRICATION

[76] Inventors: Delio Sanz; Gary M. Sanz, both of Harding Postal Outlet P.O. Box 32155, Richmond Hill, Ontario, Canada, L4C 9S3

[21] Appl. No.: 185,118

[22] Filed: Jan. 21, 1994

Related U.S. Application Data

[63] Continuation-in-part of Ser. No. 981,757, Nov. 25, 1992, Pat. No. 5,291,944.

[51] Int. Cl.[5] ..... F28D 7/16

[52] U.S. Cl. ..... 165/159; 165/910; 165/157; 29/890.03

[58] Field of Search ..... 165/158, 159, 910, 157; 29/890.03

[56] References Cited

U.S. PATENT DOCUMENTS

| | | | |
|---|---|---|---|
| 3,265,128 | 8/1966 | Legrand | 165/159 |
| 4,105,067 | 8/1978 | Bovagne | 165/159 |
| 4,357,991 | 11/1982 | Cameron | 165/159 |
| 4,622,921 | 11/1986 | Cameron et al. | 122/7 C |
| 5,044,431 | 9/1991 | Cameron | 165/158 |

*Primary Examiner*—John Rivell

*Attorney, Agent, or Firm*—Polster, Lieder, Woodruff & Lucchesi

[57] ABSTRACT

Heat exchange apparatus (10) for use in large vessels exposed to high thermal expansion and prone to acoustical noise and tube bundle resonance associated with high gas velocity comprises a shell (12) having a fluid inlet (14) and a fluid outlet (16). A plurality of heat exchange tubes (18, 20) are housed in the shell and extend parallel to each other substantially the length of the shell. The tubes are arranged so there is a central core (22), an inner layer (24) of tubes surrounding the central core, and an outer layer (26) of tubes surrounding the inner layer. The inner and outer layers of tubes are all in a common tube pattern. The tubes in one layer are rotated with respect to the tubes in the other layer. This results in tubes in both layers being arranged in different tube patterns in different portions or segments of each layer. That is, the pattern (34) of the tubes in one segment (28A) differs from the pattern (32) in adjoining arcuate and radial segments (28B, 28L, 30A). The result is a uniform resistance to flow regardless of the radial flow path of the fluid through the heat exchange apparatus.

10 Claims, 15 Drawing Sheets

HEAT EXCHANGER AND METHOD OF FABRICATION

This application is a continuation-in-part of U.S. patent application Ser. No. 07/981,757 filed Nov. 25, 1992 now U.S. Pat. No. 5,291,944.

BACKGROUND OF THE INVENTION

This invention relates to shell and tube heat exchangers and, more particularly, to a heat exchanger having an improved tube and shell configuration and a method making such a heat exchanger.

In heat exchangers, employing tubes for carrying heating or cooling fluids, it is known that the tubes can be configured in various patterns or configurations. See, for example, U.S. Pat. Nos. 5,044,431 and 4,357,991. As shown or disclosed therein, the heat exchange tubes are configured in circular or elliptical patterns, with certain spacing requirements between the tubes being specified. In the '991 patent, the tubes extend vertically of a shell and are arranged in a concentric pattern. In the '431 patent, the tubes also extend vertically of a shell but are either arranged in a generally elliptical pattern, or in a square or rectangular pattern with each side of the square or rectangle concavely curving. In each instance, the tube arrangement is to facilitate compact tube packing while maintaining uniform fluid flow through the individual tubes.

It is known that in a heat exchanger, the fluid flows into the heat exchanger at one point, is directed through the tube arrangement both by placement of the tubes themselves, as well as by baffles, for example, and then exits the heat exchanger at a second location. To maximize heat transfer, not only is the tube arrangement as discussed in the above referenced patents important, but so are matters such as uniform flow paths, the prevention of acoustical noise, resonance or vibration, the physical size of heat exchanger required for the particular tasks, etc. While the various tube configurations shown and described in these patents try to address some of these problems, it will be noted with respect to the above referenced patents, that there are still non-uniform flow paths (for example, at the corners of the various tube layouts of the '431 patent) which result in some of the problems discussed above. On the other hand, some heat exchangers built in accordance with the '991 patent are known to generate acoustical noise. Other arrangements are, however, possible by which not only-is more efficient heat transfer achieved, but in which these other problems are solved.

In addition to the aforementioned, another significant factor in these prior heat exchangers is their cost. One problem attendant with some earlier heat exchangers is that due to their size, they could only be manufactured on site. Fabricating the exchanger in a shop (where fabrication costs are much lower), transporting the unit to the site, and installing it there is preferable.

SUMMARY OF THE INVENTION

Among the several objects of the present invention may be noted the provision of an improved tube layout for a heat exchanger; the provision of such a layout in which the tubes and their associated baffles are arranged to produce a serpentine pattern of flow through the exchanger for more efficient heat transfer; the provision of such an arrangement for providing an increased efficiency regardless of whether a heating or cooling fluid flows around and through the tubes; the provision of such an arrangement in which the tubes are so arranged that a central core area of the exchanger may be free of tubes to facilitate better distribution of flow and an inner and outer layer of tubes produced by selecting a layer of tubes adjacent the inner or outer circumference of tubes and shifting this layer radially with respect to the other tubes; the provision of such a tube arrangement wherein the tubes patterns about and inner and outer layer of tube produce a uniform resistance to fluid flow regardless of the radial fluid flow path through the heat exchanger; the provision of such a heat exchanger in which the resulting inner tube layer may be circular, hexagonal, and other polygonal shapes, which may have curvilinear aspects; the provision of such a tube arrangement to provide a uniform heat transfer rate through the heat exchanger, and to obtain a uniform shellside distribution of flow, this uniformity of fluid flow producing a uniform thermal expansion of the tubes and reduced stress forces within the heat exchanger; the provision of such a tube arrangement to prevent acoustical noise and harmful vibrations which can result from tube bundle resonance caused by vortex shedding, and various tube layout geometry; the provision of such a heat exchanger to have an inwardly rather than an outwardly tending expansion joint thereby to save space; the provision of such a tube and shell arrangement which readily fabricated in a shop for transportation and installation at a use site thereby to be lower cost than such prior art arrangements which were only manufacturable on site; and, the provision of such an arrangement which is usable in place of conventional arrangements presently used in heat exchangers.

In accordance with the invention, generally stated, a heat exchange apparatus comprises a shell having a fluid inlet and a fluid outlet. A plurality of heat exchange tubes are housed in the shell. The tubes extend parallel to each other substantially the length of the shell. The tubes are arranged such that there is a central core devoid of tubes. An inner layer of tubes surrounds the central core, and an outer layer of tubes surrounding the inner layer. The inner and outer layers of tubes comprise tubes having a uniform tube pattern. The layers of tubes are created by taking a circumferential thickness of tubes and rotating them with respect to the remaining tubes, by 30° for example. The resultant formation is such that fluid flowing radially outwardly from the central core encounters a uniform resistance to flow through the inner and outer layer of tubes regardless of the radial direction of the flow. Also, the flow path through the inner and outer layers is such there is a uniform resistance to the flow of fluid. This uniformity in turn results in a uniform fluid flow velocity, heat transfer rate; and, importantly, uniform thermal expansion of the tubes. This reduces the stress within the heat exchanger. Baffles and end supports support the tubes installed in the shell. The baffles and end supports are arranged such that they produce a serpentine fluid flow path through the shell along the length of the tubes thereby to further increase heat transfer. Other objects and features will be in part apparent and in part pointed out hereinafter.

BRIEF DESCRIPTION OF THE DRAWINGS

FIG. 9 represents an initial arrangement of tubes in a triangular tube pattern, FIG. 10 the removal of tubes from the inner core and outer margin of the heat exchanger, FIG. 11 illustrates rotation of tubes in one layer (the outer layer) 30° with respect to those in the inner layer, and FIG. 12, a view similar to FIG. 4 representing the resultant heat exchanger tube configuration;

FIG. 13 and 14 are views similar to FIGS. 5 and 6 and respectively illustrating a square and rotated square tube pattern;

Corresponding reference characters indicate corresponding parts throughout the drawings.

DESCRIPTION OF THE PREFERRED EMBODIMENT

Figure 1:
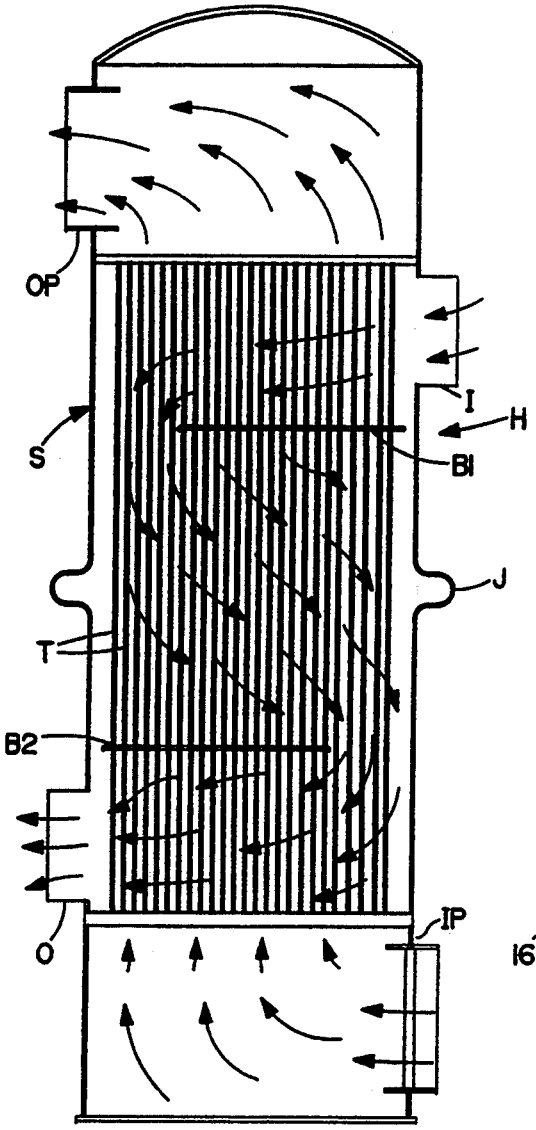
FIG. 1 PRIOR ART
FIG. 1 is a sectional view of a conventional shell and tube heat exchanger.
Figure 2:
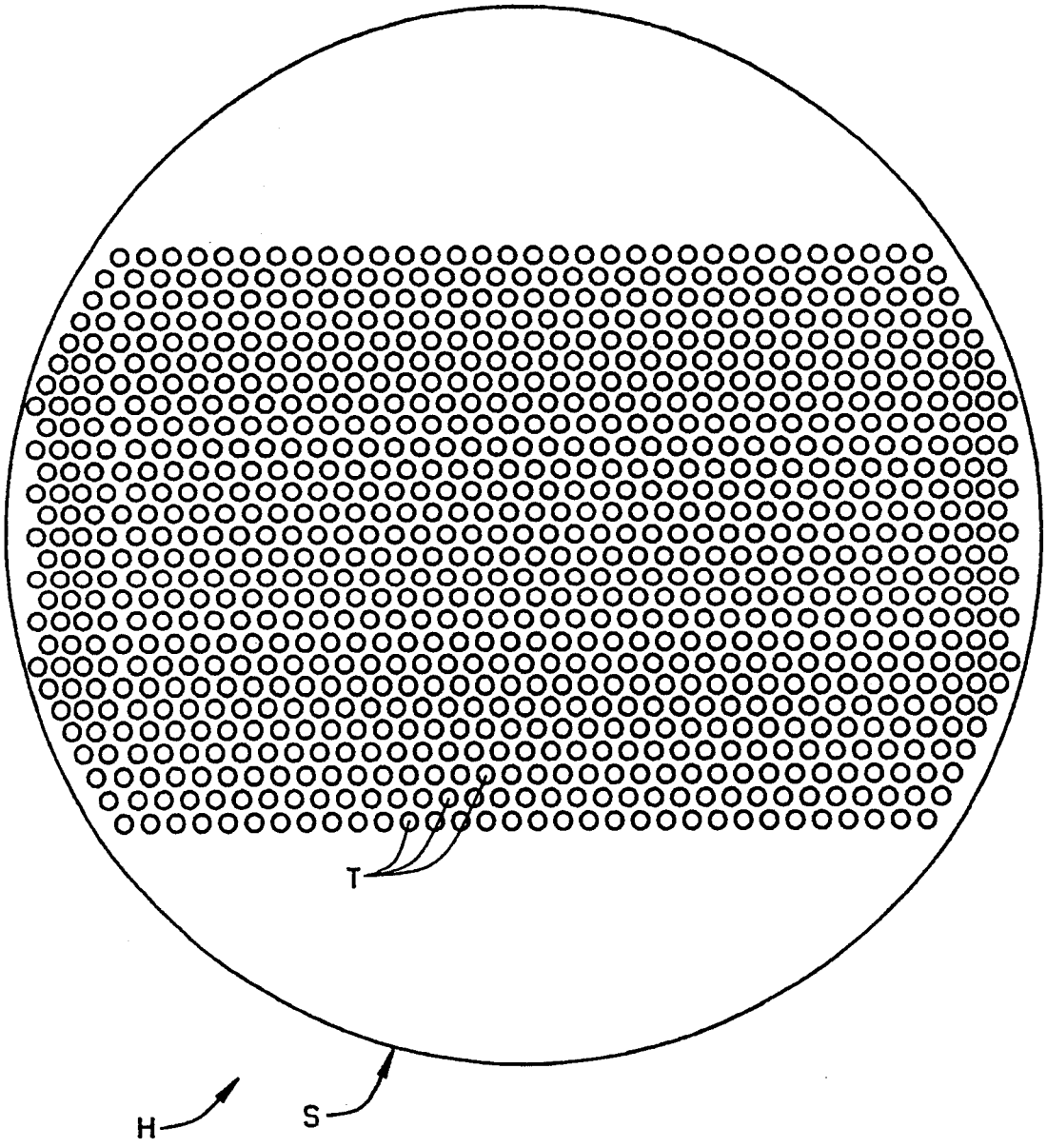
FIG. 2 PRIOR ART
FIG. 2 is a plan view of a conventional tube layout in the heat exchanger of FIG. 1.

Referring to the drawings, a conventional heat exchanger H is shown in FIG. 1. This heat exchanger has a circular shell S in which is arranged a plurality of heat exchanger tubes T. An example of the arrangement of tubes T is shown in FIG. 2. Shell S has a fluid inlet I at its upper end and an outlet O at its lower end. The heat exchange gas enters through a plenum IP at the base of the shell, flows upwardly the tubes in a heat exchange relationship with the fluid, and exits the heat exchanger through an outlet plenum OP at the upper end of the shell. The heat exchange tubes are supported at their upper and lower ends and by respective baffles B1 and B2 at points intermediate the length of the tubes. Baffle B1 extends substantially, but not wholly across the inside of shell S from side of the shell. Baffle B2 is similarly shaped and extends across the inside of the shell from the opposite side. Accordingly, the baffle arrangement forces the fluid to flow on a serpentine path through the heat exchanger. This increases the heat exchange path length, the amount of fluid turbulence, and consequently, the amount of heat exchange which occurs.

Shell S also has an expansion joint as indicated at J in FIG. 1. The joint creates a circumferential bulge in the outer surface of the shell and accordingly increases the overall diameter of the heat exchanger. Depending upon the size of the expansion joint, this has the drawback of limiting those areas in which heat exchanger H can be used. A further problem is the lack of portability of the heat exchanger. This means the unit must be fabricated on-site rather than in a shop. This greatly adds to the cost of the heat exchanger.

Figure 3:
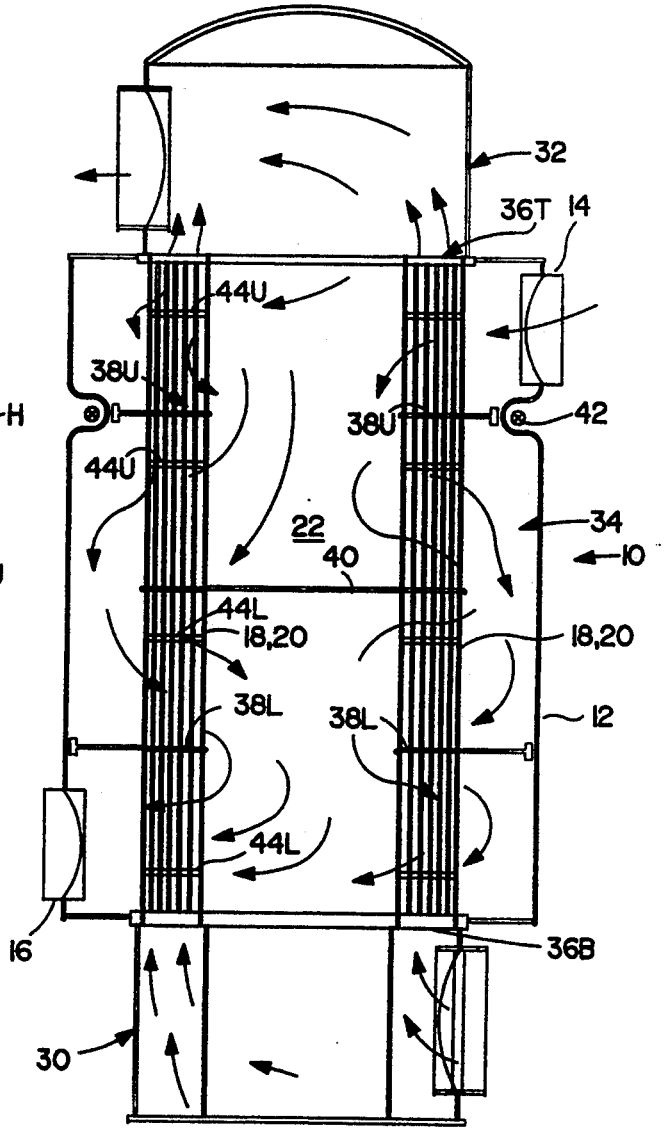
FIG. 3 is a sectional view of an improved shell and tube heat exchanger of the present invention.

Referring to FIG. 3, a heat exchanger 10 of the present invention is shown to have a shell 12. Shell 12 is a hollow circular shell having a fluid inlet 14 at its upper end, as viewed in FIG. 3, and a fluid outlet 16 at its lower end. A plurality of heat exchange tubes 18, 20 (see FIGS. 4–6) are housed in the shell. Tubes 18, 20 extend parallel to each other substantially the length of the shell. The tubes are circular in cross-section and are all generally the same length. One of the tubes may have a larger outer diameter than the other and the heat exchange efficiency of the tubes may also be different. Or, the tubes may all be of the same inner and outer diameter and have the same thermal efficiency. Also, heat exchanger 10 can be used as a gas-gas heat exchanger, or as a liquid-gas, liquid-liquid heat exchanger. As shown in the drawings, the tubes are arranged such that there is a central core 22 which unlike many prior heat exchangers is devoid of tubes. The tubes are preferably arranged such that there is an inner layer 24 of tubes surrounding the central core, and an outer layer 26 of tubes surrounding the inner layer.

Each layer of tubes is divided into a plurality of arcuate segments. Layer 24 is divided into twelve segments 28A–28L, and layer 26 into twelve segments 30A–30L. The segments in layer 24 subscribe the same arc as the corresponding segments in layer 26. It is a particular feature of the invention that the tubes in one segment be of a different tube pattern than the tubes in the adjoining arcuate (circumferential) and radial segments. Thus, for example, the tubes in segment 28A of layer 24 are arranged in a different pattern than the tubes in the adjacent arcuate segments 28B and 28L. They are also arranged in a different pattern from the tubes in the adjacent radial segment 30A.

Figure 5:
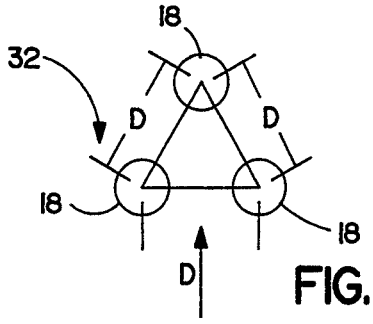
FIG. 5 is a plan view of a triangular tube pattern in one segment of tubes to produce a first flow pattern.
Figure 6:
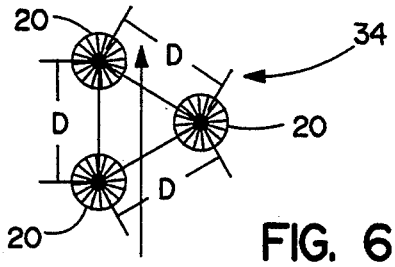
FIG. 6 is a view similar to FIG. 5 illustrating a rotated triangular tube pattern in the other segment of tubes to produce a second flow pattern.

Referring to FIGS. 5 and 6, the two different patterns 32 and 34 respectively, in which the tubes are arranged are shown. In FIG. 5, the tubes 18 are shown to be arranged in an equilateral triangle with the tubes being spaced a distance D apart from each other. The direction of fluid flow into the tube pattern is indicated by the arrow. As shown, the fluid must be diverted around the tubes as it flows radially outwardly from core 22. Thus, this tube pattern sets up a resistance to flow.

In FIG. 6, the tubes 20, which may be identical to the tubes 18, are represented differently only for purposes of understanding the invention, are also arranged in an equilateral triangle with the distance D separating each tube in the pattern. However, the tube pattern 34, while having the same pitched tube pattern, is rotated with respect to pattern 32. As shown by the arrow representing the direction of fluid flow from the core, there is less resistance to flow in the tube segments in which the tubes are arranged in this pattern. However, the formation of multiple layers of tubes, arranged by segments in the checkered pattern shown in FIG. 4, produces fluid flow paths of equal resistance regardless of the radial direction of flow. This, in turn, results in a constant flow velocity.

Figure 10:
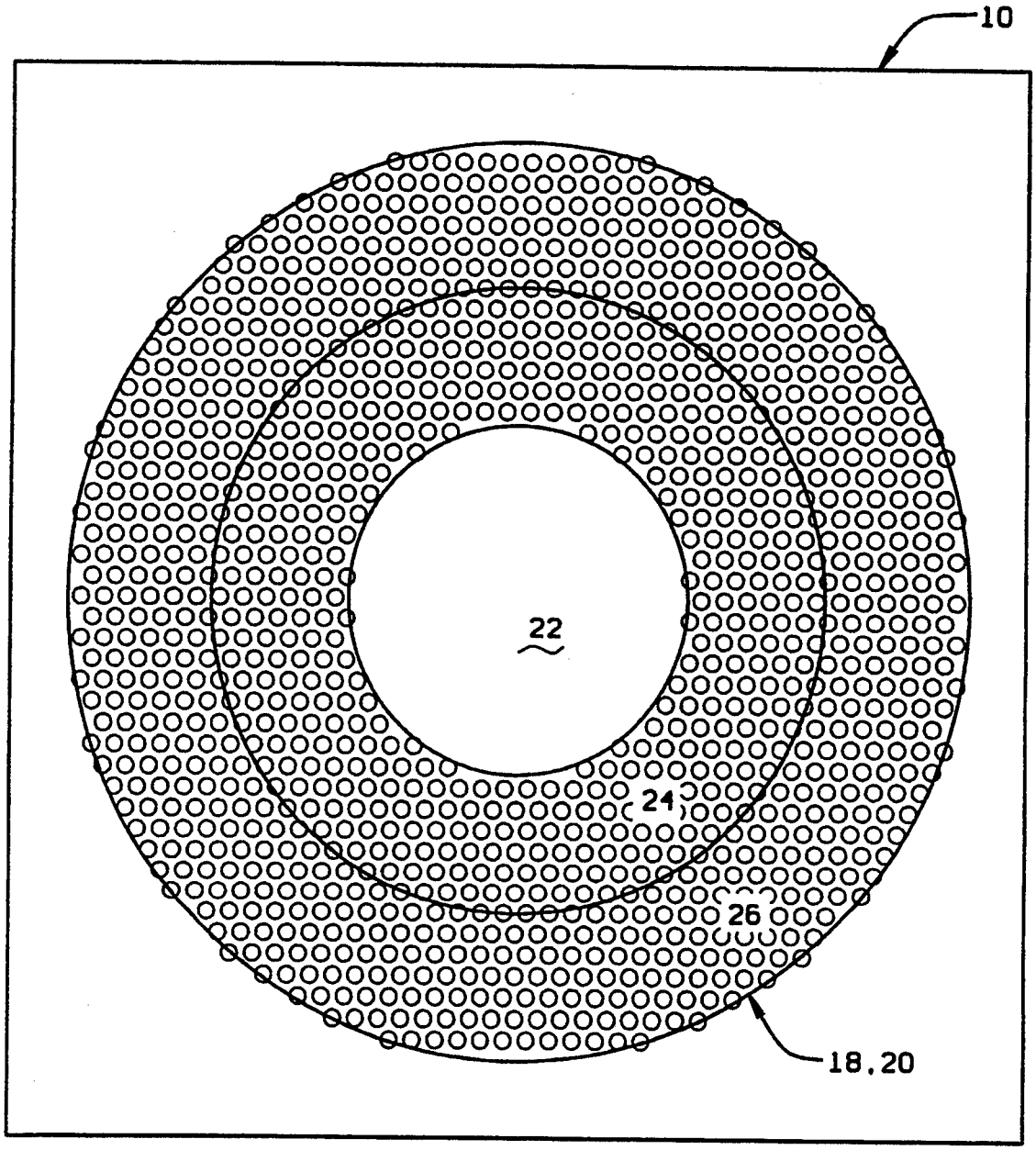
Figure 11:
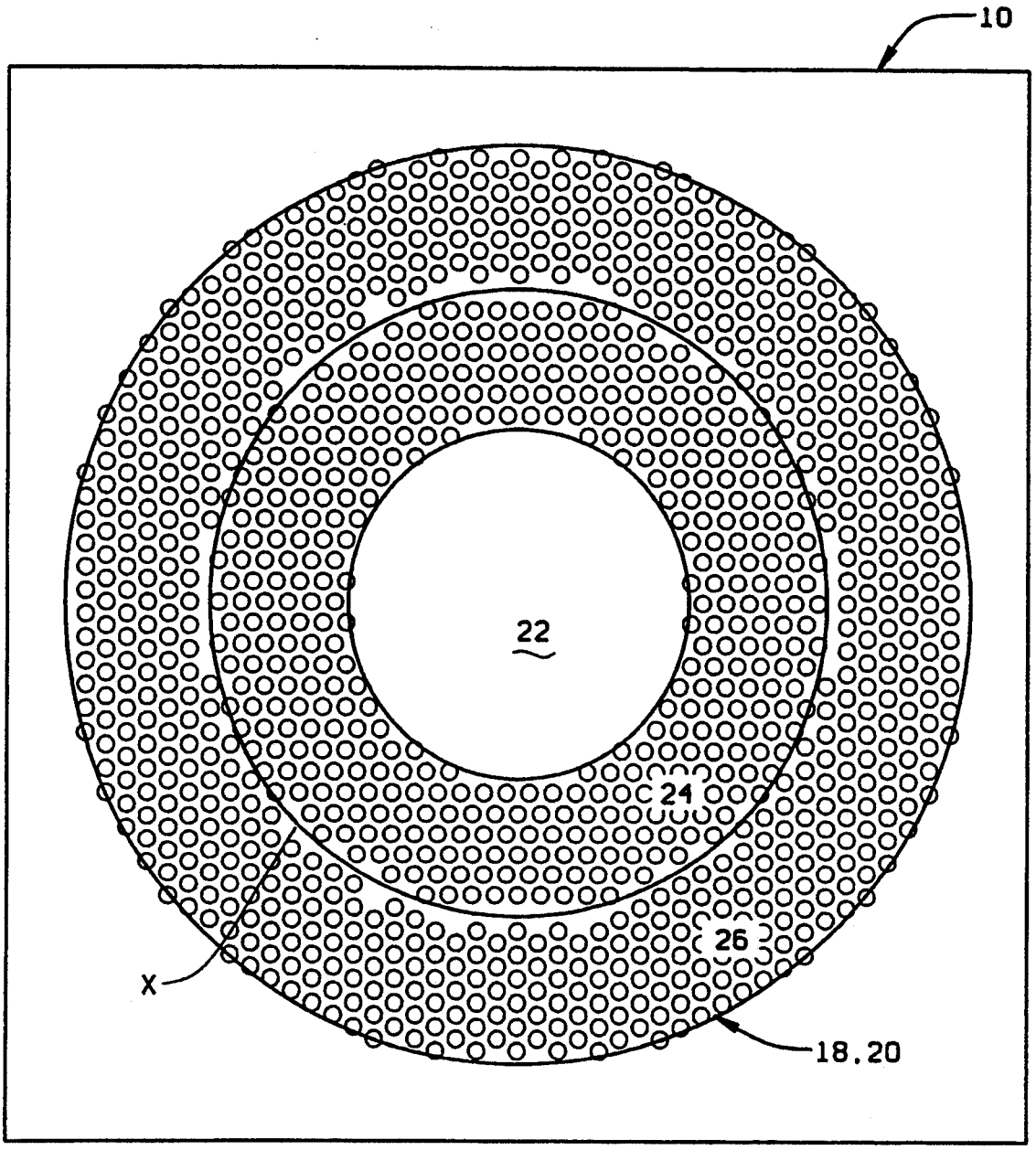

While FIGS. 5 and 6 represent one tube pattern arrangement between adjacent segments, FIG. 10 illustrates an alternate arrangement. The pattern 34 of tubes 20 in FIG. 10 corresponds to the shown in FIG. 6. The vertical dashed line represents the boundary between adjacent segments. The left side pattern 34′ of tubes 20′ is the "mirror image" of tube pattern 20. Thus, it will be understood that a variety of tube patterns may be employed from one segment to the adjacent segment without departing from the scope of the invention.

Figure 4:
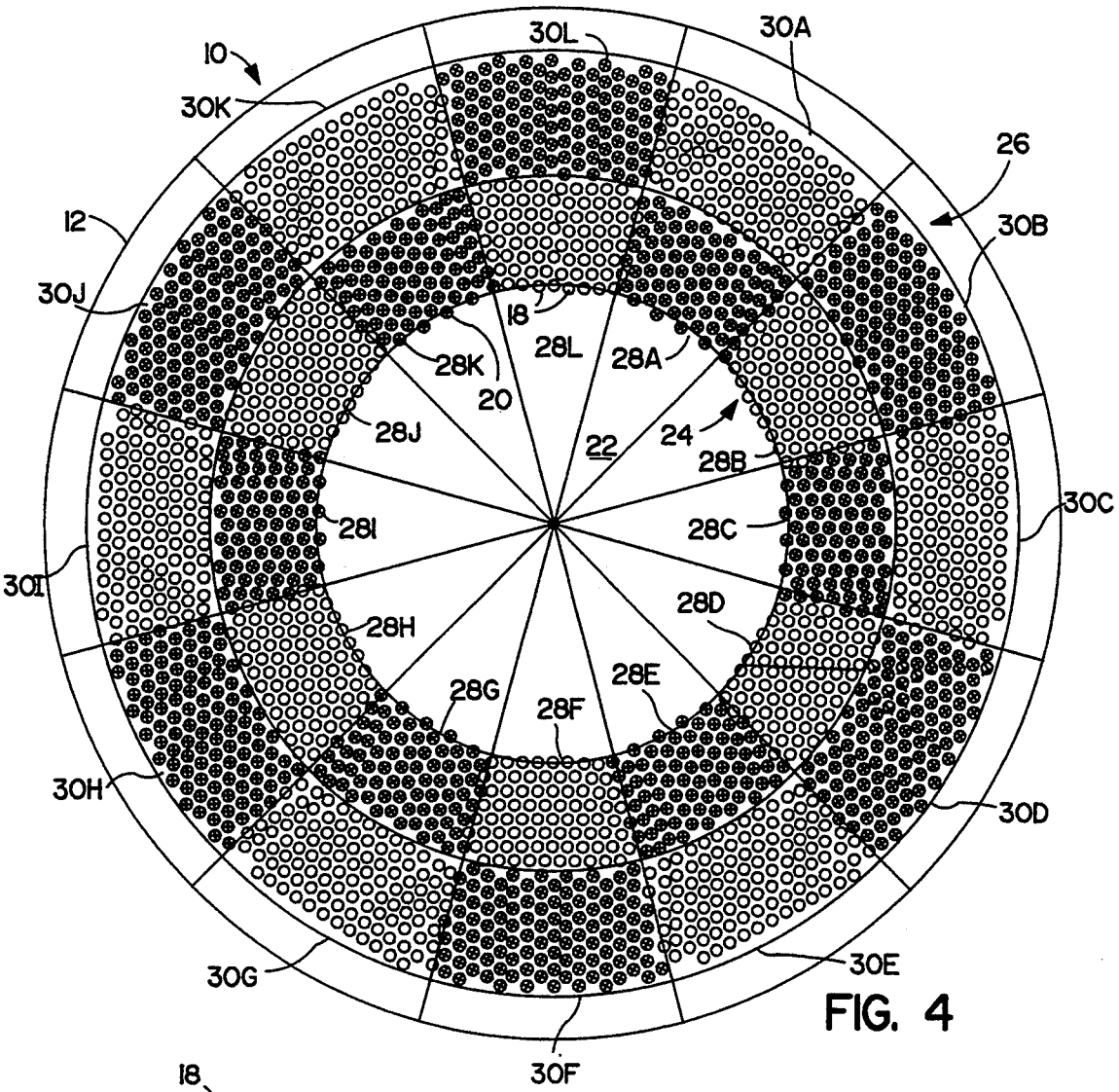
FIG. 4 is a plan view of a tube layout providing uniform fluid flow paths for uniform thermal expansion of the tubes, as well as suppression of acoustical noise and tube bundle resonance.

In FIG. 4, there are the same number of rows of tubes in each segment. Eight rows of tubes comprise each layer 24 and 26. By dividing the layers into arcuate segments, and by having the tube pattern in one segment differ from that in the adjacent arcuate and radial segments, a number of advantages are achieved. Now, unlike prior heat exchanger tube configurations, fluid flowing radially outwardly from central core 22 has an equidistant flow path from the core through the inner and outer layers to the shell regardless of the direction of flow. This not only produces more efficient heat exchange and one with a uniform heat transfer rate throughout the heat exchanger, but less stress is also placed on the tubes. This is because the thermal expansion of the tubes which results from heat exchange operations is substantially uniform throughout the heat exchanger. Also, by staggering or alternating tube patterns in the adjacent segments, the possibility of a harmful resonance condition being created is eliminated. This, even though the radial flow path from core 22 provides a uniform resistance to flow in all directions. The different geometry in the adjacent tube pattern segments produces different tube vibration frequencies. Since these frequencies are unequal, they do not produce a potentially harmful compound effect. A common example of this is soldiers not marching in the same cadence when crossing a bridge.

Returning to FIG. 3, for example, heat exchanger 10 includes a heat exchange gas inlet plenum 30 located at the base of shell 12, and a gas outlet plenum 32 at the top of the shell. A support means 34 of the heat exchanger includes respective top and bottom end plates 36T and 36B in which the respective upper and lower ends of the tubes are mounted. The heat exchange gas flows into the bottom of the tubes 18, 20, upwardly through the tubes, and discharges out of the tubes at their upper end.

Support means 34 further includes upper and lower baffles 38U and 38L, and a center baffle 40. Baffle 38U is located below inlet 14 and comprises a disk having a central opening corresponding to the diameter of core 22. Baffle 38L which is located above outlet 16 is similarly constructed.

Baffle 40 comprises a disk whose diameter corresponds to that of the central core plus that of the first and second layer of tubes. The baffle is centrally positioned to block fluid flow downwardly between the tubes. Accordingly, baffle 38U directs fluid entering inlet 14 onwardly through the two layers of tubes into the core 22 portion of the tube arrangement until baffle 40 is reached. The fluid then flows radially outwardly through the two layers of tubes and down about the outside of the tubes. At the lower end of the shell, baffle 38L again directs the fluid inwardly through the tubes toward core 22. The result is a serpentine fluid flow path from inlet 14 to outlet 16. The result is a serpentine fluid flow path from inlet 14 to outlet 16. This path increases fluid turbulence and the amount of contact between the fluid and the exchange tubes thereby enhancing the amount of heat exchange which takes place.

Shell 12 includes an expansion joint 42 to help relieve stress inherent in the heat exchanger when it is in operation. As shown in FIG. 1, joint 42 includes an inwardly turned circumferential ring extending around the shell. Such a joint design is important because, unlike prior heat exchange designs, it has, in part, the function of baffle 38U, and in addition, the function of an expansion joint. As an added benefit, joint 42 now does not increase the overall diameter of the heat exchanger. Thus the heat exchanger can be smaller in size and can be used in more confined spaces and is more readily transportable than the conventional heat exchanger shown in FIG. 1. There, the expansion joint significantly increases the overall diameter of the heat exchanger.

In addition to the baffles, the heat exchanger further includes a tube support 44U and a tube support 44L. These supports are located intermediate the respective upper and lower baffles 38U and 38L and baffle 40. These supports are not used to direct flow, but because of their presence can reduce acoustical noise. For this purpose, these supports are installed off-center, i.e., closer to one of the baffles.

Figure 7:
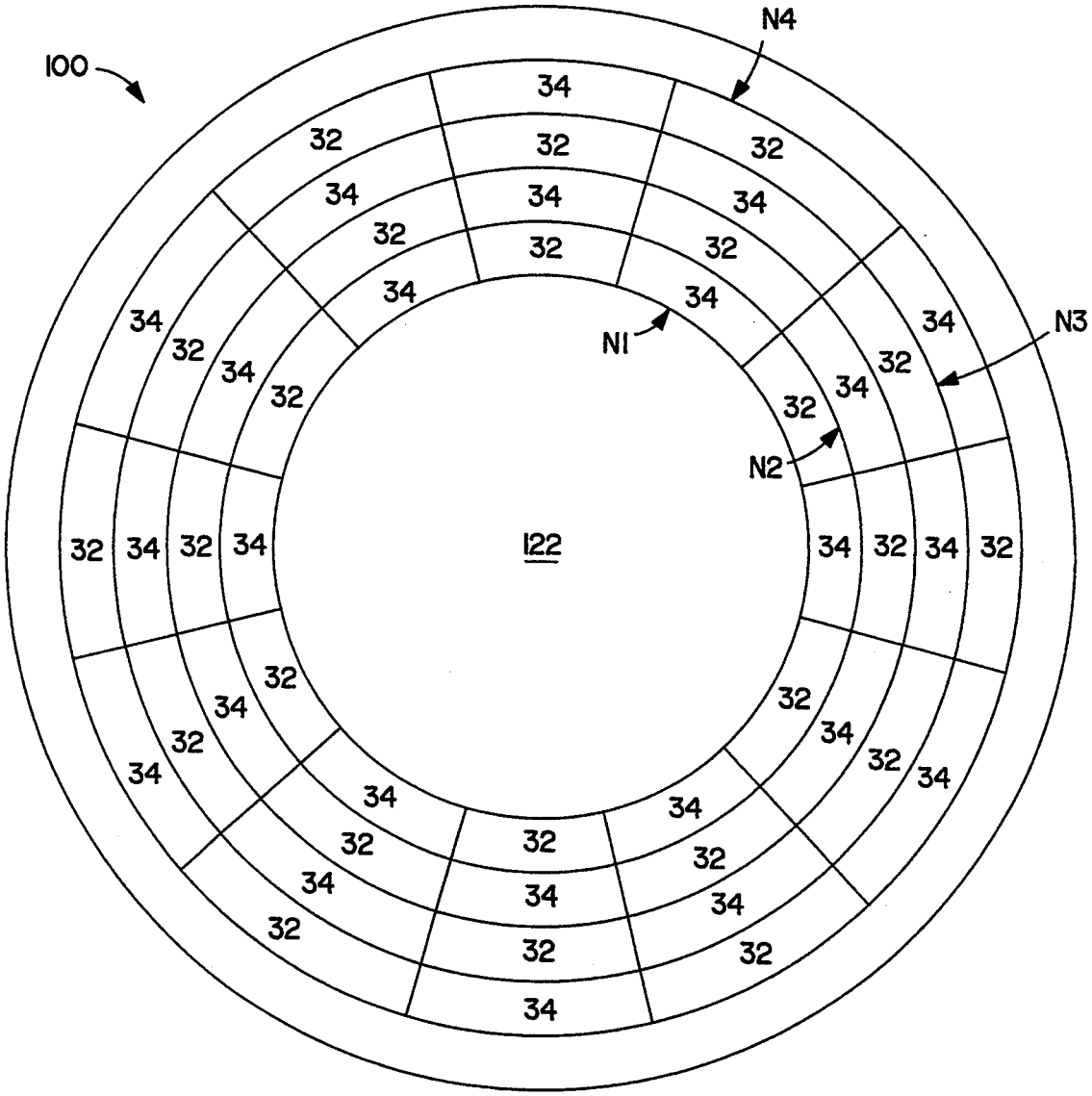
FIGS. 7 and 8 represent alternate embodiments of the present invention.
Figure 8:
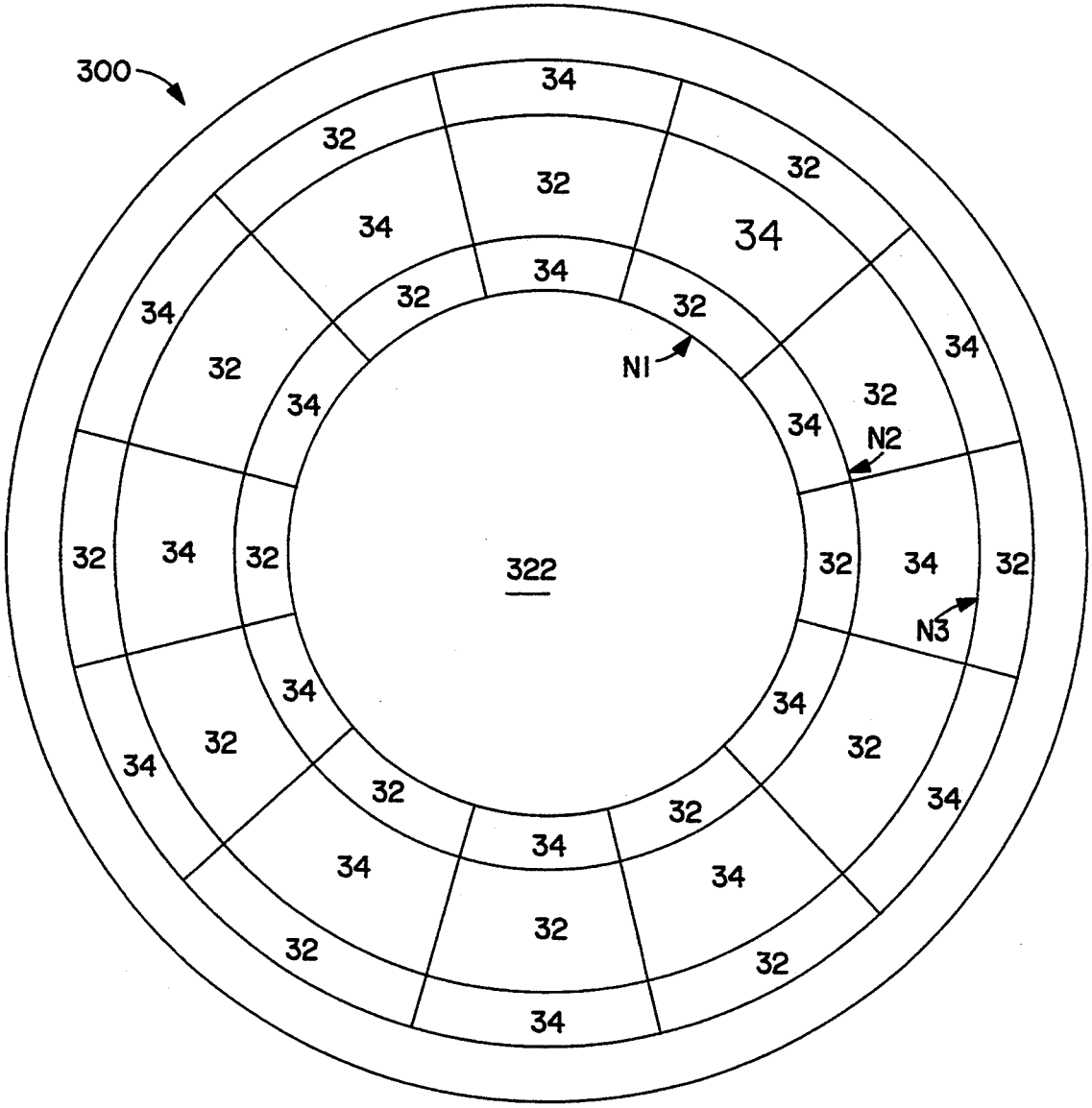

Referring to FIGS. 7–8, alternate embodiments of a heat exchanger employing the present invention are shown. The heat exchanger can, for example, have N layers. If N is an even number, for example, 2 as shown in FIG. 4; or 4, as shown in FIG. 7, there only need to be two tube patterns such as the patterns 32 and 34. In FIG. 7, a heat exchanger 100 has a hollow core 122 and four layers of tubes (N=4) N1–N4. The various arcuate and radial segments have tubes arranged in the patterns 32 and 34 shown in FIGS. 5 and 6.

Alternatively, as shown in FIG. 8, N can be an odd number such as 3 or 5. In FIG. 8, N=3. Thus, in FIG. 8, a heat exchanger 300 has three tube layers N1–N3 respectively surrounding core 322. To provide the equidistant flow paths which have uniform resistance to flow regardless of the direction of flow, the tubes are arranged in three separate patterns P1–P3. But the layer P2 is wider than P1 and P3. Further, each layer of tubes is divided in twelve arcuate segments. The arrangement of tubes in the various patterns as shown in FIG. 8, provide the desired flow characteristics. For an odd number of layers, the advantages of the invention are also realized if the number of segments in each layer are a multiple of N. It will be understood that the previous discussion concerning tube patterns such as mirror-image patterns and shifting segments in accordance with the given formula apply equally as well to these alternate embodiments.

Figure 9:
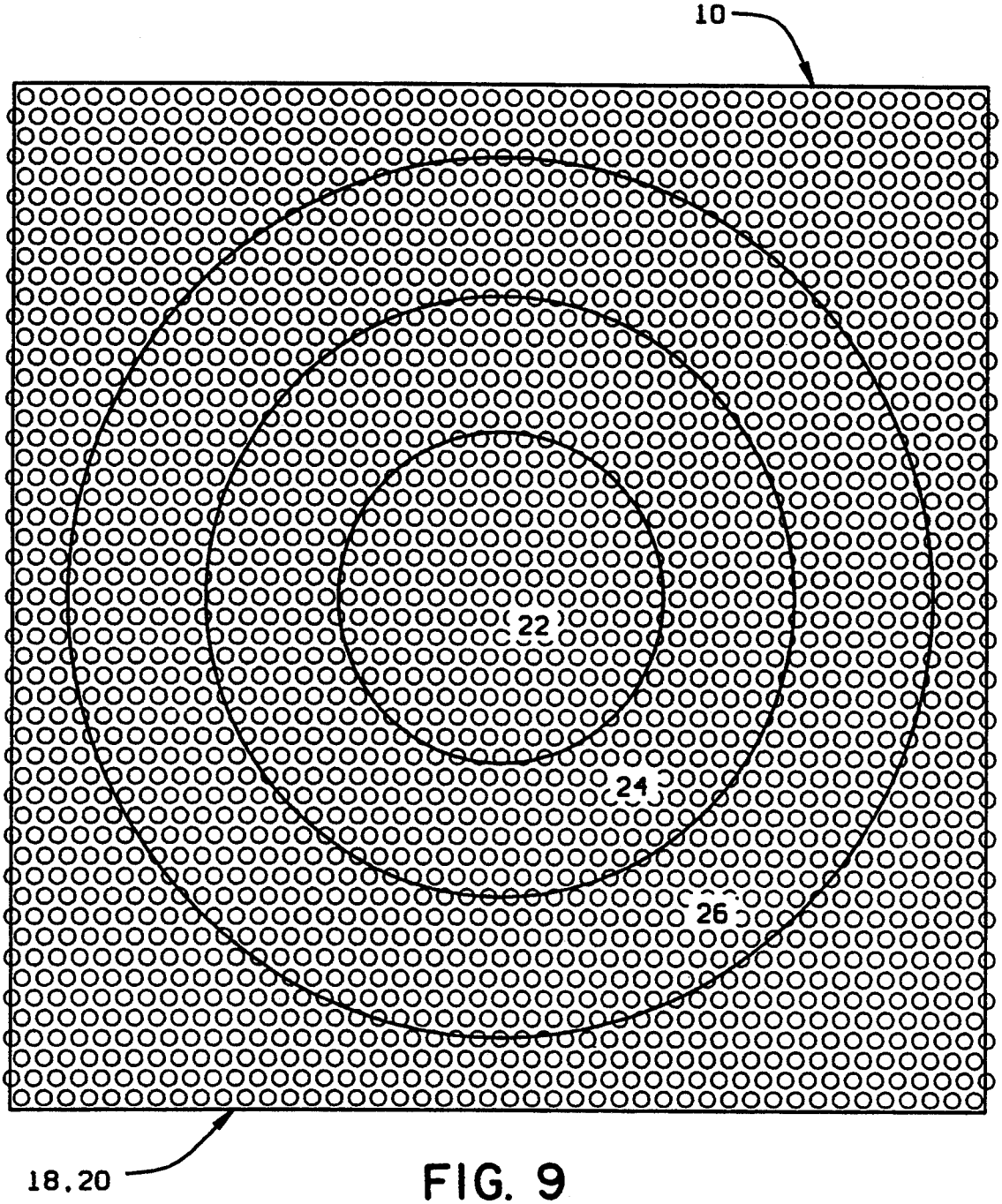
FIGS. 9–13 represent an alternate approach to understanding manufacture of the heat exchanger where
Figure 12:
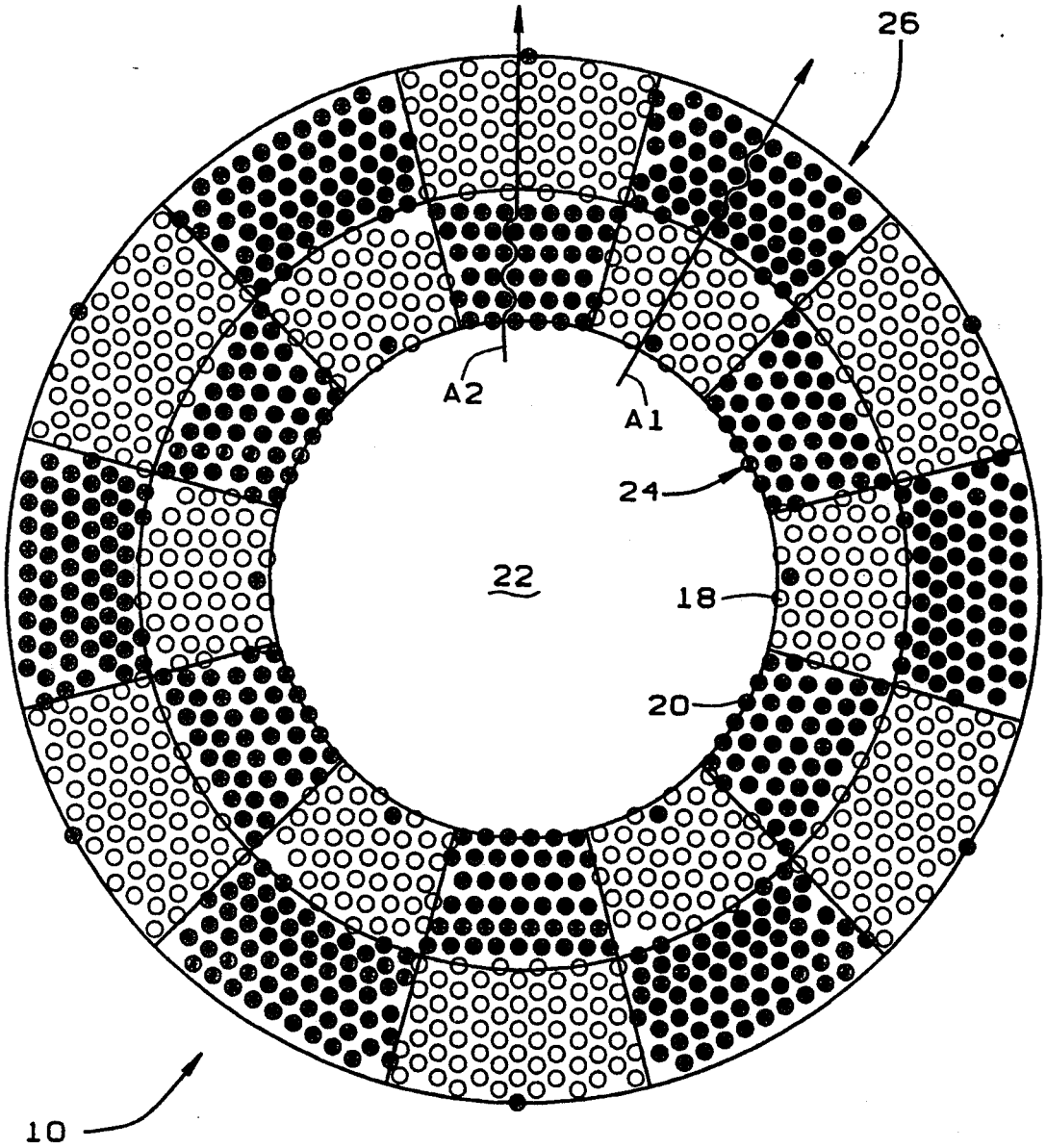

The method of fabricating heat exchanger 10 is illustrated using FIGS. 9–12. Referring to FIG. 9, heat exchanger 10 is shown to be square or rectangular cross-section. All of the tubes in the heat exchanger arrangement of FIG. 9 have the same tube pattern; i.e. a triangular tube pattern. The heat exchanger of the present invention is now formed by first identifying the size of the heat exchanger required for a particular application. Once this determination is made, the tubes within the central core 22 of the heat exchanger and the area outside of the outer layer 26 are removed. This is as shown in FIG. 10. The tube pattern of the remaining tubes is still the same as before. Next, a circular boundary X, which is an artificial boundary (that is, no physical boundary or divider is placed between layers 24, 26) is determined. The tubes to the inside of the boundary (i.e., toward core 22) remain in place. All the tubes to the outside of this boundary are now uniformly rotated 30° in one direction or the other. It is important to understand that this done not by rotating the tubes 30° about their longitudinal axis with the tubes remaining in place. Rather, the entire arrangement of tubes is rotated 30° . When this is done, the resulting tube arrangement is as shown in FIG. 12, and is substantially identical to that shown in FIG. 4. Again, the tubes 18, 20 are identical, but are distinguished to illustrate those tubes in a standard triangular pattern, and those in a rotated triangular pattern. It is important to understand that the triangular or rotated triangular tube patterns which now exist in the segments 28A–28L and 30A–30L are created by this rotation of the tubes in the one layer with respect to the tubes in the other layer. Again, no boundaries, dividers, or other forms of separation are necessary to produce the resultant tube patterns in the various areas of the heat exchanger. It will be appreciated that at the boundary between the respective segments, tubes may be removed or added to provide uniformity, but there is no wholesale rearrangement of tubes required to produce heat exchanger 10. The tube patterns about the exchanger again are created by rotating the tubes in the one layer 30° with respect to the tubes in the other layer.

With respect to flow paths, the arrow A1 in FIG. 12 indicates that the flow along this path can follow a straight path through the tubes in inner layer 26 but its flow is blocked by the tubes in the corresponding segment of outer layer 28. The resultant wavy flow path occurs because the tubes in this segment are now in a different triangular orientation. The reverse is true for the flow path indicated by arrow A2.

Figure 13:
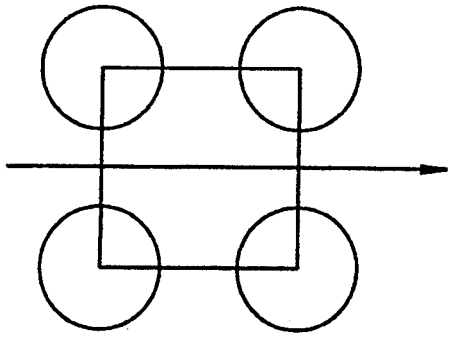
Figure 14:
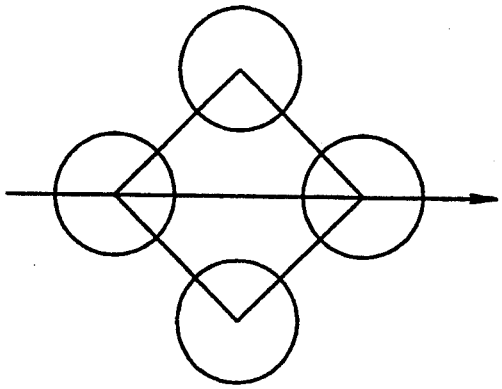

Besides the triangular and rotated triangular patterns previously described, the tubes can also be arranged in square and rotated square patterns as shown in FIGS. 13 and 14.

Figure 15:
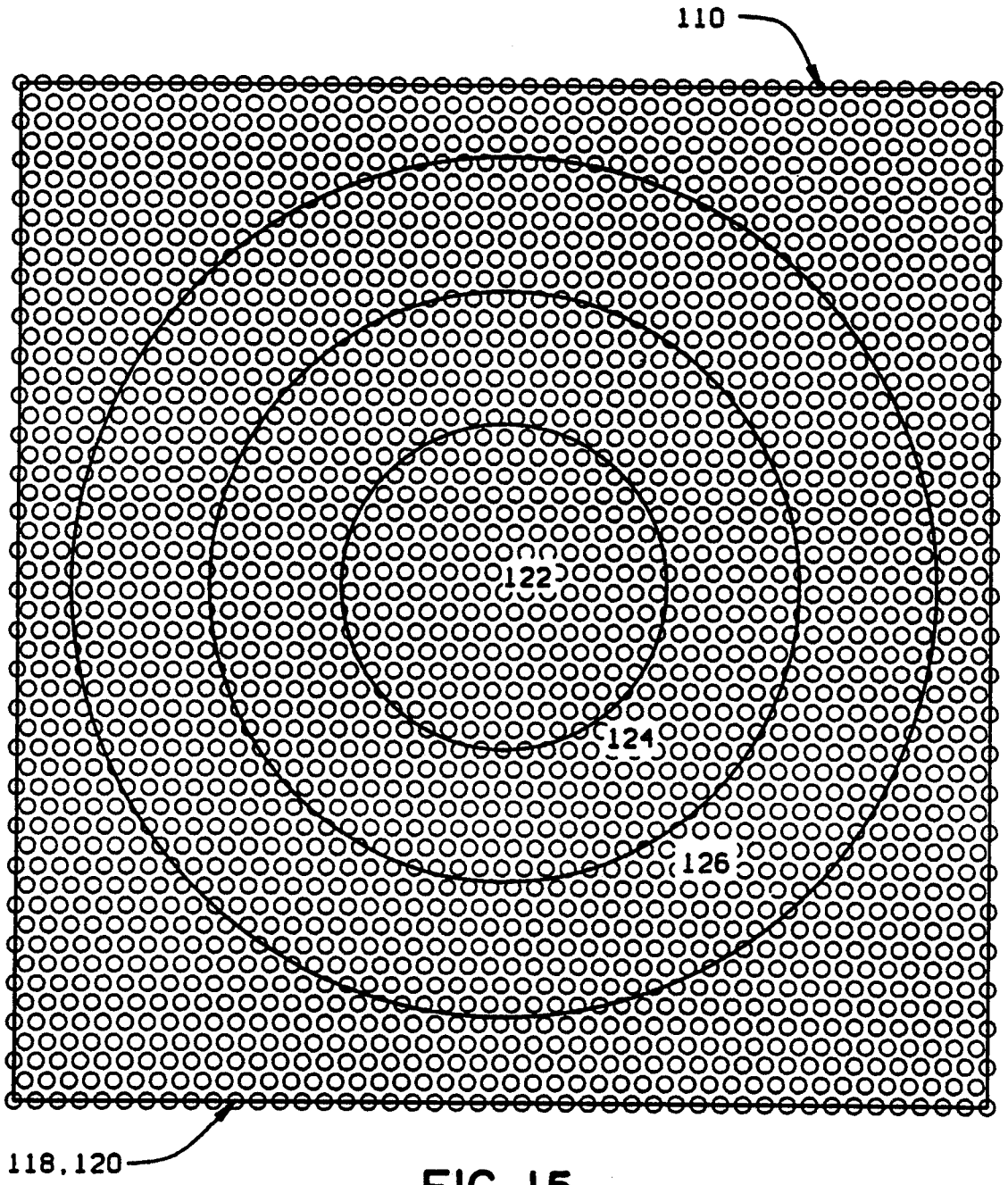
FIGS. 15–17 illustrate creation of another heat exchanger embodiment of the present invention having a square and rotated square tube pattern; and, FIGS. 18–20 represent additional heat exchanger constructions obtainable using the method of the present invention.
Figure 16:
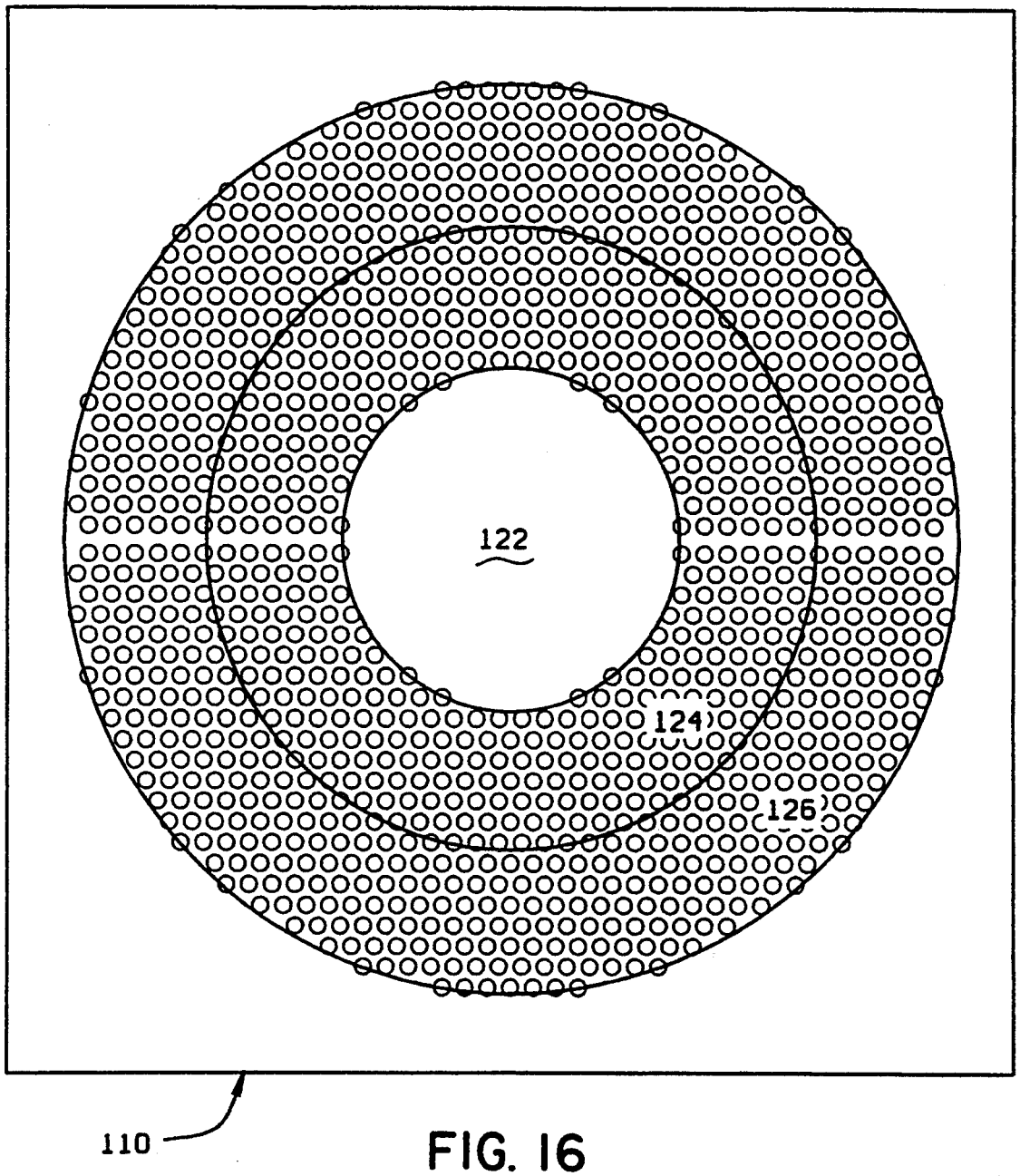
Figure 17:
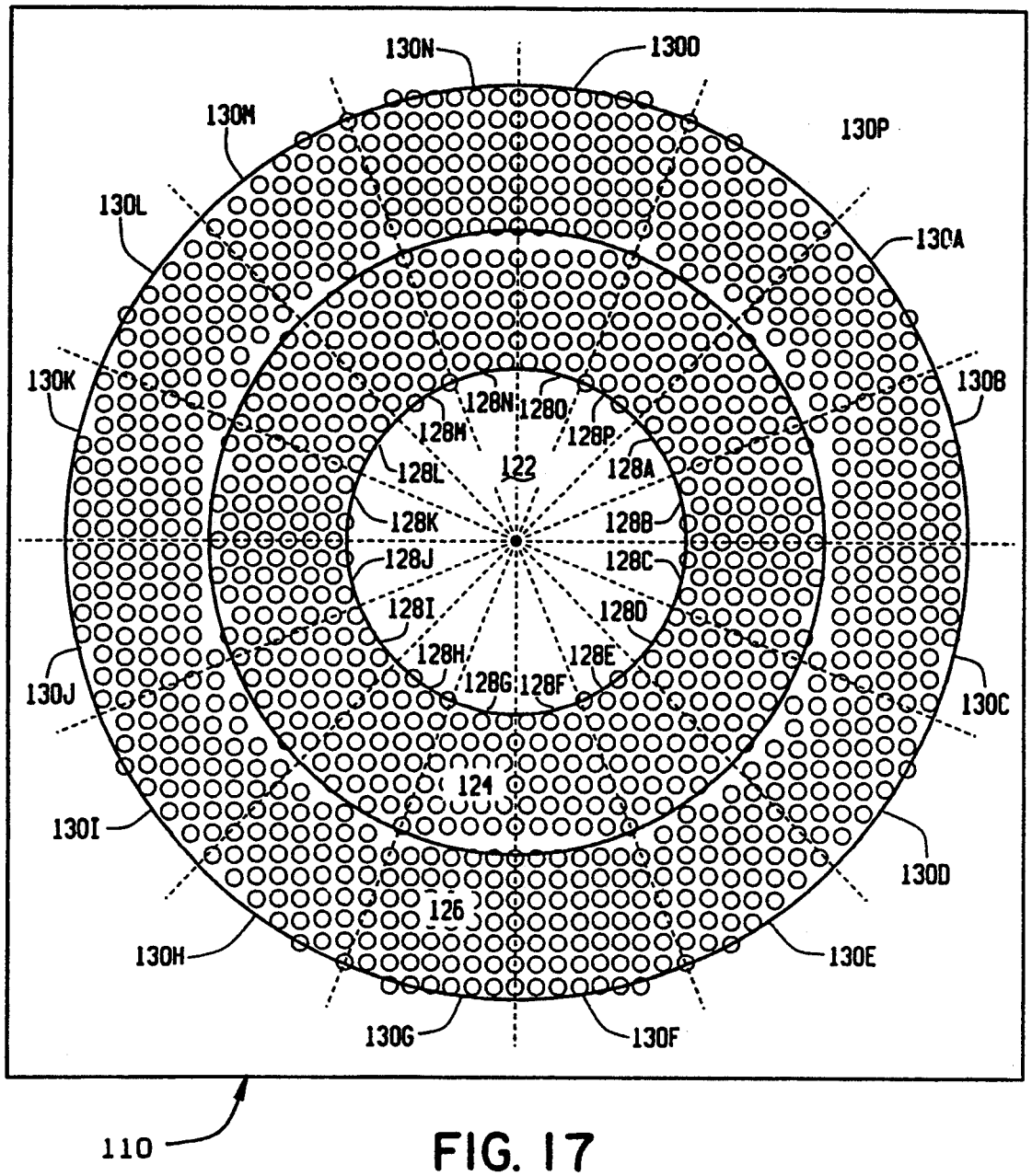

FIGS. 15–18 illustrate a heat exchanger 110 comprised of heat exchange tubes 118, 120 which are arranged in the rotated square pattern of FIG. 14. FIG. 15 illustrates the initial tube configuration. In FIG. 16, the tubes have been removed from central core 122 of the heat exchanger and from the portion of the heat exchange outside of outer layer 126. As previously described, a division is determined as between the number of tubes comprising and inner layer of tubes 124 and an outer layer 126. Since the tubes are in a square rather than triangular pattern, the tubes in the outer layer are rotated 45° in this embodiment to produce the arrangement shown in FIG. 17. In FIG. 17, the result is sixteen segments in each layer; segments 128A–128P in layer 124, and 130A–130P in layer 126. Now, the tubes in one segment have a square pattern and those in adjacent circumferential and radial segments have a rotated square pattern, these patterns resulting from the rotation described.

Figure 18:
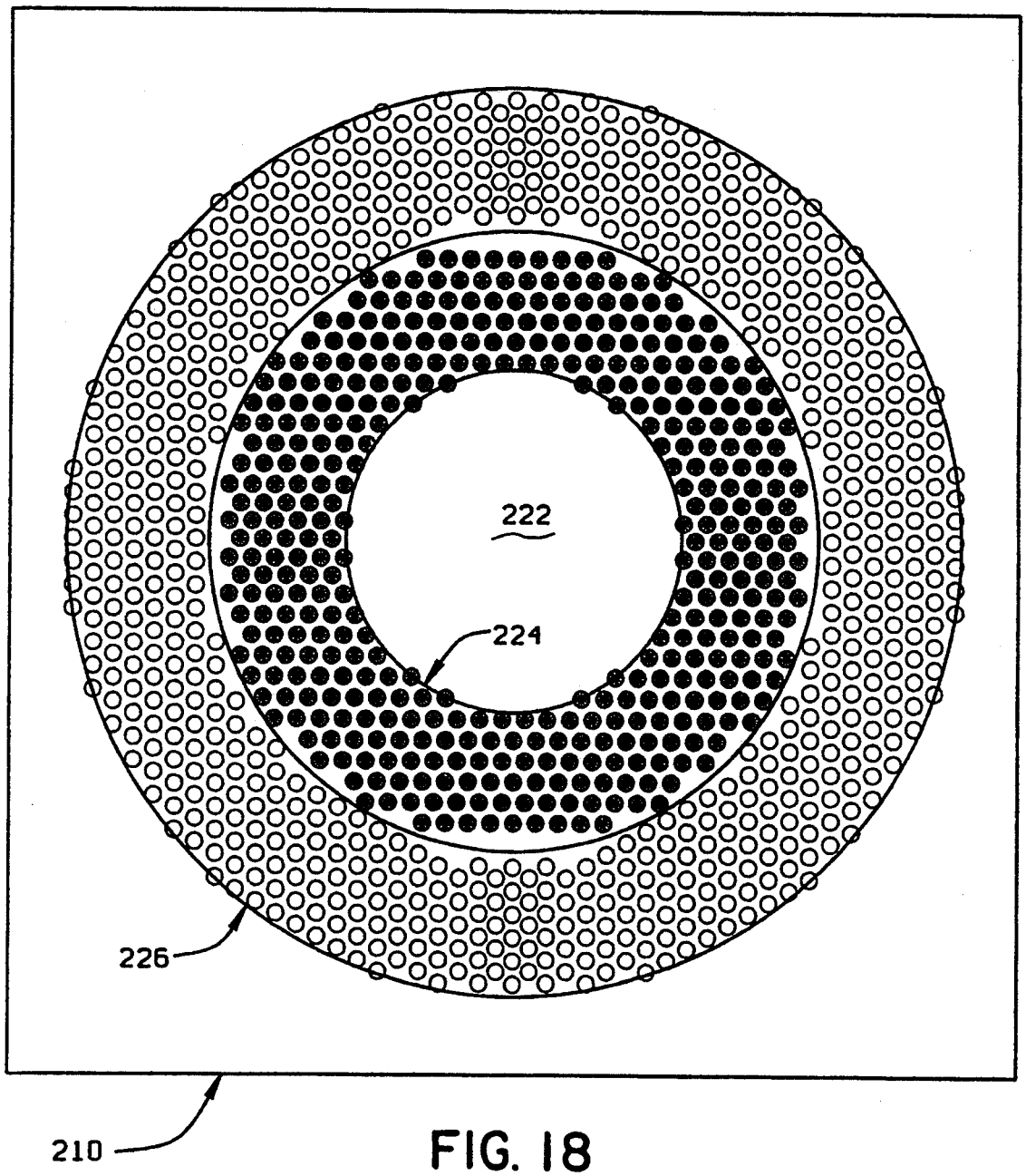
Figure 19:
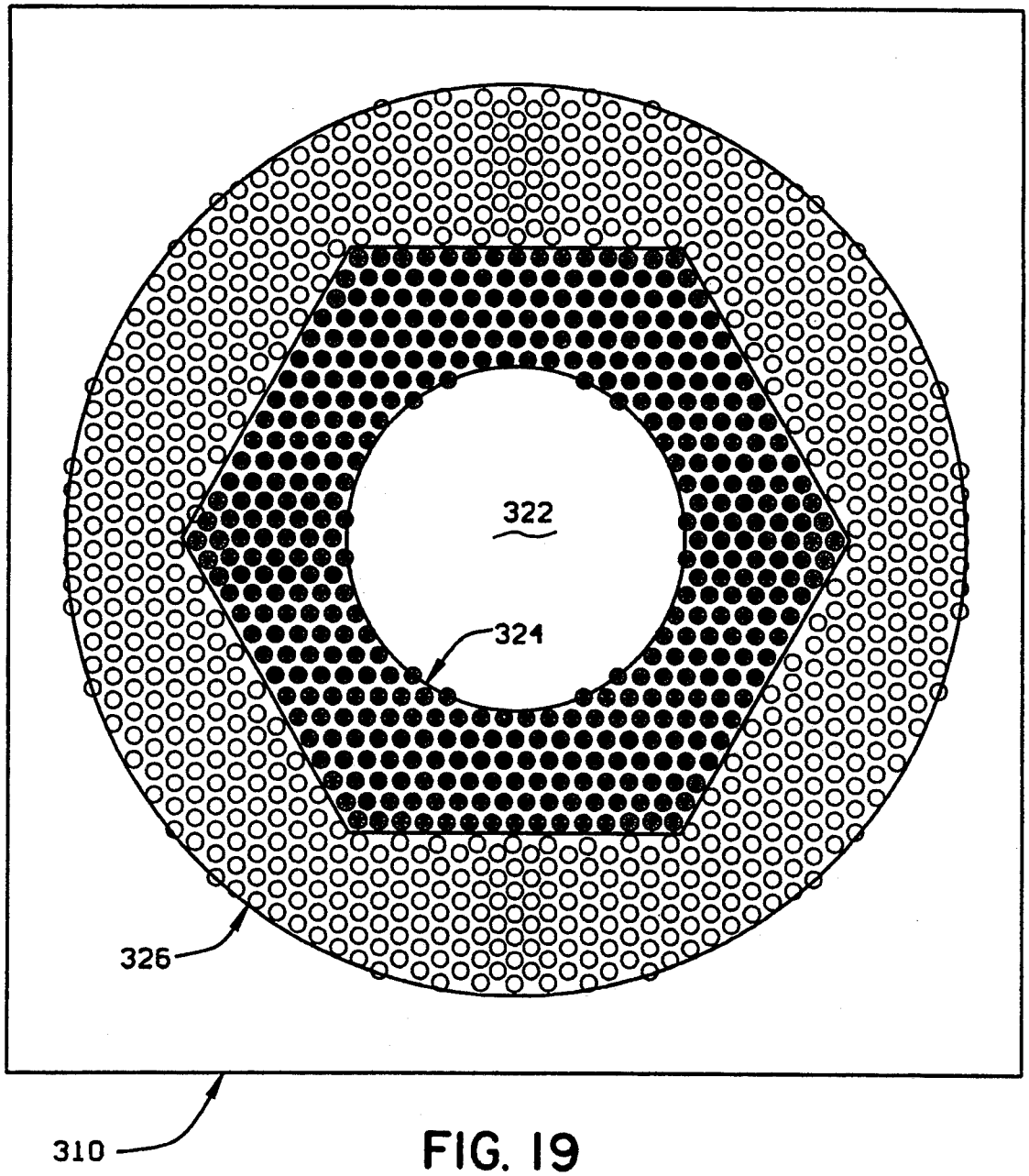
Figure 20:
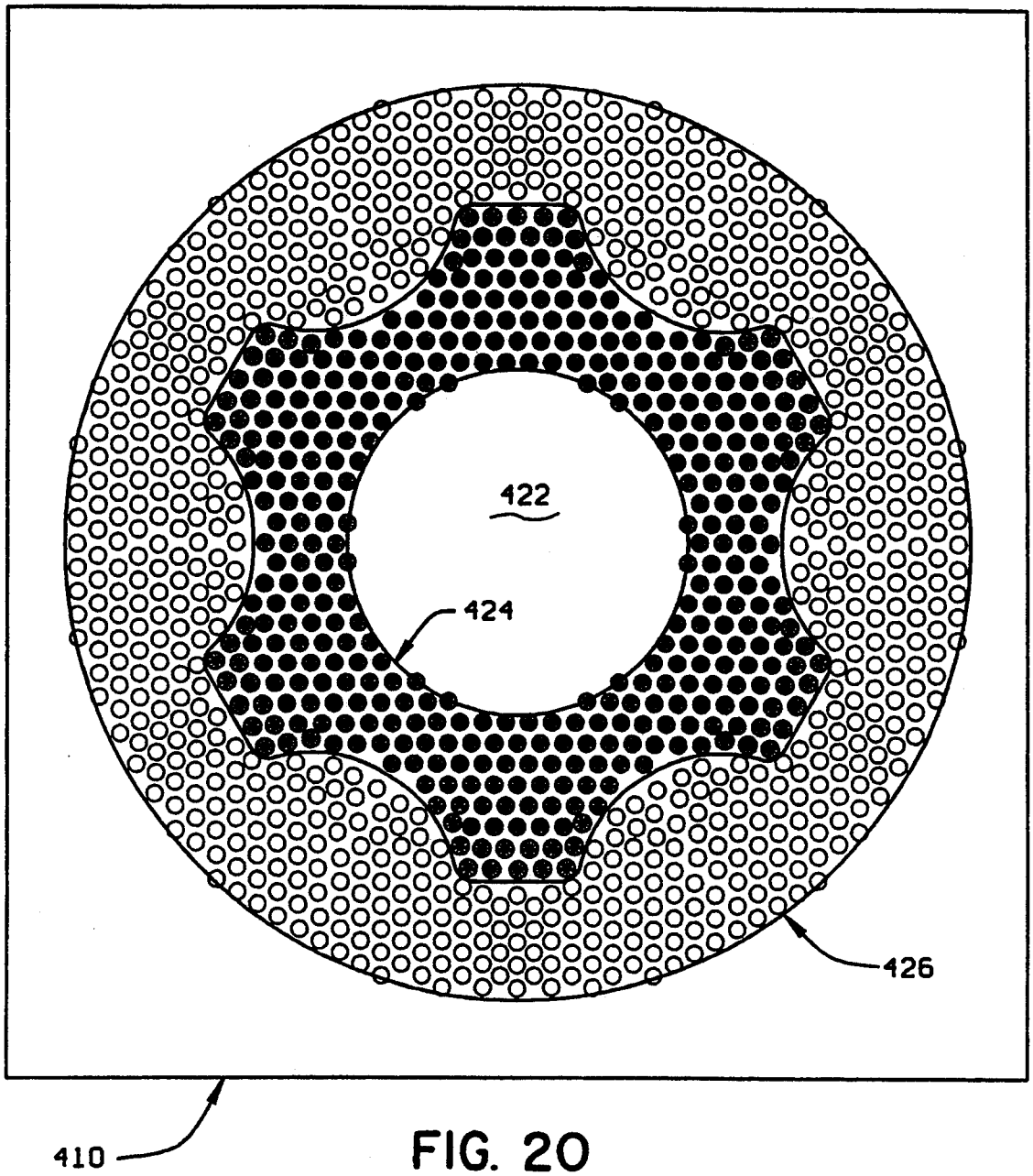

Besides the heater exchanger 10 and 110 constructed in accordance with the method of the present invention, other heat exchanger constructions can also be made. In FIG. 18, a heat exchanger 210 has a central core 222, an inner layer 224 of tubes, and an outer layer 226 of tubes. The tubes in this heat exchanger have a triangular tube pitch with the tubes in the outer layer again be rotated 30° with respect to those in the inner layer. In FIG. 19, a heat exchanger 310 has a central core 322, an inner layer 324, and an outer layer 326. While the resulting configuration of tubes in the inner and outer layers in the previous embodiments have been circular or toroidal, here the inner layer 324 has a hexagonal appearance after the rotation. Finally, in FIG. 20, a heat exchanger 400 has a central core 422, an inner layer 424, and an outer layer 426. In the embodiment, the resulting inner layer is generally hexagonal but has curvilinear portions. It will be understood that other polygon shapes may be obtained using the method of the invention.

What has been described is an improved heat exchanger including an improved tube layout for the heat exchanger. The layout of tubes is such as to produce more efficient heat transfer as well as reduce potential stresses, reduce acoustical noise, and eliminate tube bundle resonance. Particularly with respect to the tube arrangement, the tubes are so arranged that a central core area of the exchanger is free of tubes. Further, the tubes are radially aligned so an equidistant radial fluid flow path exists regardless of the direction of fluid flow. Finally, the heat exchanger has an inwardly rather than an outwardly extending expansion joint which makes the heat exchanger smaller in diameter than conventional heat exchangers so it is more readily shop fabricated for transportation to a use site.

In view of the foregoing, it will be seen that several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A heat exchanger comprising:

a shell having a fluid inlet and outlet;

a plurality of heat exchanger tubes housed in the shell and extending substantially parallel to each other, the tubes being arranged in a predetermined tube pattern throughout the exchanger, the tubes being divided into an inner layer of tubes and an outer layer thereof, one layer of tubes being rotated with respect to the other layer thereof with the resultant arrangement of tubes creating alternating patterns of tubes both radially from a central core of the heat exchanger, and circumferentially about the core with the alternating patterns producing uniform resistance to flow regardless of the flow path through the heat exchanger; and, means for supporting the tubes.

2. The heat exchanger of claim 1 wherein the tubes are arranged in a triangular pattern and the one layer of tubes is rotated 30° with respect to the other layer.

3. The heat exchanger of claim 1 wherein the tubes are arranged in a square pattern and the one layer of tubes is rotated 45° with respect to the other layer.

4. The heat exchange apparatus of claim 1 wherein the inner and outer layer have a concentric circular profile.

5. The heat exchange apparatus of claim 1 wherein the inner layer has a hexagonally shaped profile.

6. The heat exchange apparatus of claim 1 wherein the inner layer is a polygonally shaped layer portions of which are curvilinear in profile.

7. A method of fabricating a heat exchanger comprising:

assembling a plurality of tubes having a defined tube pattern in a shell with the tubes extending parallel to each other and substantially the length of the shell;

removing a number of the tubes from the center of the tube assembly to form a central core devoid of tubes;

defining a first layer of remaining tubes extending circumferentially about the central core, and a second layer of remaining tubes extending circumferentially about the inner layer; and, rotating one layer of tubes with respect to the other layer thereof thereby to form an alternating tube pattern configuration throughout the heat exchanger by which a uniform resistance to flow is created throughout the heat exchanger regardless of the direction of flow.

8. The method of claim 7 wherein the outer layer of tubes is rotated with respect to the inner layer.

9. The method of claim 7 wherein the tubes are arranged in a triangular tube pattern and th outer layer of tubes is rotated 30° with respect to the inner layer.

10. The method of claim 7 wherein the tubes are arranged in a square pattern and the outer layer of tubes is rotated 45° with respect to the inner layer.

* * * * *